US009668633B1

(12) United States Patent
Cervantes

(10) Patent No.: US 9,668,633 B1
(45) Date of Patent: Jun. 6, 2017

(54) PORTABLE MOP CLEANING APPARATUS

(71) Applicant: J. Rosario Cervantes, Fresno, CA (US)

(72) Inventor: J. Rosario Cervantes, Fresno, CA (US)

( * ) Notice: Subject to any disclaimer, the term of this patent is extended or adjusted under 35 U.S.C. 154(b) by 127 days.

(21) Appl. No.: 14/745,864

(22) Filed: Jun. 22, 2015

(51) Int. Cl.
*A47L 13/59* (2006.01)
*A47L 13/60* (2006.01)

(52) U.S. Cl.
CPC ..... *A47L 13/60* (2013.01)

(58) Field of Classification Search
CPC ..... A47L 13/58; A47L 13/59; A47L 13/60
See application file for complete search history.

(56) References Cited

U.S. PATENT DOCUMENTS 1,803,297 A * 4/1931 Schneider ..... A47L 13/60 15/262
1,922,981 A 8/1933 Robertson
3,987,513 A 10/1976 Gonzales
4,912,804 A * 4/1990 Pasbol ..... A47L 13/253 15/262
4,928,505 A 5/1990 Parks et al.
RE36,599 E * 3/2000 De Guzman ..... A47L 13/59 100/122
6,487,749 B1 * 12/2002 Tsui ..... A47L 13/60 15/262
7,434,292 B2 10/2008 Ramirez Moreno
7,437,795 B1 10/2008 Bez
8,381,931 B1 2/2013 Ernest, III
8,635,736 B2 1/2014 Matola
8,696,028 B2 4/2014 Nelson
2003/0217428 A1 11/2003 Perelli
2014/0263104 A1 * 9/2014 Kepner ..... A47L 13/58 210/791
2015/0230686 A1 * 8/2015 Ramirez Moreno ... A47L 13/59 15/261

* cited by examiner

*Primary Examiner* — Shay Karls
(74) *Attorney, Agent, or Firm* — Thomas R. Lampe

(57) ABSTRACT

Mop cleaning apparatus including a mobile cart, a mop cleaning assembly including two rollers attached to a tank on the cart, and a handle used to move the cart and also operable to change the distance between two rollers of the mop cleaning assembly to receive a mop head and form a nip for wringing the mop head.

3 Claims, 5 Drawing Sheets

PORTABLE MOP CLEANING APPARATUS

TECHNICAL FIELD

This invention relates to mop cleaning apparatus, more particularly, a mobile cart employed to support and convey tanks for supporting fluids relating to mop cleaning and a mop cleaning assembly operatively associated with one of the tanks for cleaning the mop head of a mop also conveyed by the cart.

BACKGROUND OF THE INVENTION

Portable mop wringers and mop bucket assemblies are known generally in the prior art. The following patent documents are believed to be representative of the current state of the prior art in this field: U.S. Pat. No. 7,437,795, issued Oct. 21, 2008, U.S. Pat. No. 8,696,028, issued Apr. 15, 2014, U.S. Pat. No. 8,635,736, issued Jan. 28, 2014, U.S. Pat. No. 4,928,505, issued May 29, 1990, U.S. Pat. No. 8,381,931, issued Feb. 26, 2013, U.S. Pat. No. 7,434,292, issued Oct. 14, 2008, U.S. Pat. No. 3,987,513, issued Oct. 26, 1976, U.S. Pat. No. 1,922,981, issued Aug. 15, 1933, U.S. Patent App. Pub. No. US 2003/0217428, published Nov. 27, 2003 and U.S. Patent App. Pub. No. US 2014/0263104, published Sep. 18, 2014.

DISCLOSURE OF INVENTION

The present invention relates to a portable mop cleaning apparatus incorporating a number of features not taught or suggested by the prior art. The present invention is characterized by its ease of use and efficiency of operation as compared to known approaches.

The portable mop cleaning apparatus includes a mobile cart with a first tank having a first tank interior. A second tank having a second tank interior is positioned adjacent to the first tank.

A mop cleaning assembly is positioned on the first tank and disposed over the first tank interior.

The mop cleaning assembly includes a rotatable first roller and a rotatable second roller, the first and second rollers relatively movable between a first condition wherein the first and second rollers are disengaged sufficiently to allow a mop head of a mop to pass substantially freely between the first and second rollers when the mop head is manually inserted into the mop cleaning assembly and a second condition wherein the first and second rollers form a nip with the mop head disposed therebetween.

A handle on the mobile cart is operatively associated with the cleaning assembly and is used not only to transport the mobile cart but also employed to cause relative movement of the first and second rollers between the first condition and the second condition.

Other features, advantages and objects of the present invention will become apparent with reference to the following description and accompanying drawings.

BEST MODE FOR CARRYING OUT THE INVENTION

Figure 1:
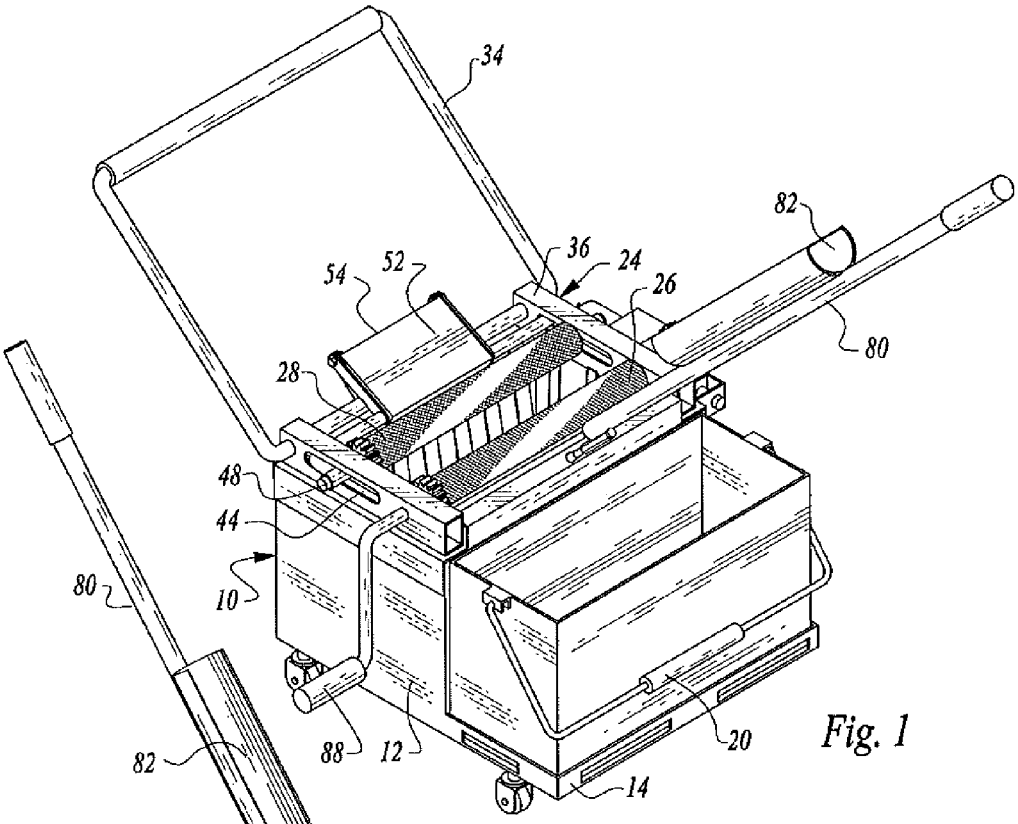
FIG. 1 is a frontal, perspective view of portable mop cleaning apparatus constructed in accordance with the teachings of the present invention with the handle shown in the position normally used to move the mobile cart and also showing the mop head engagement rollers spaced apart.
Figure 2:
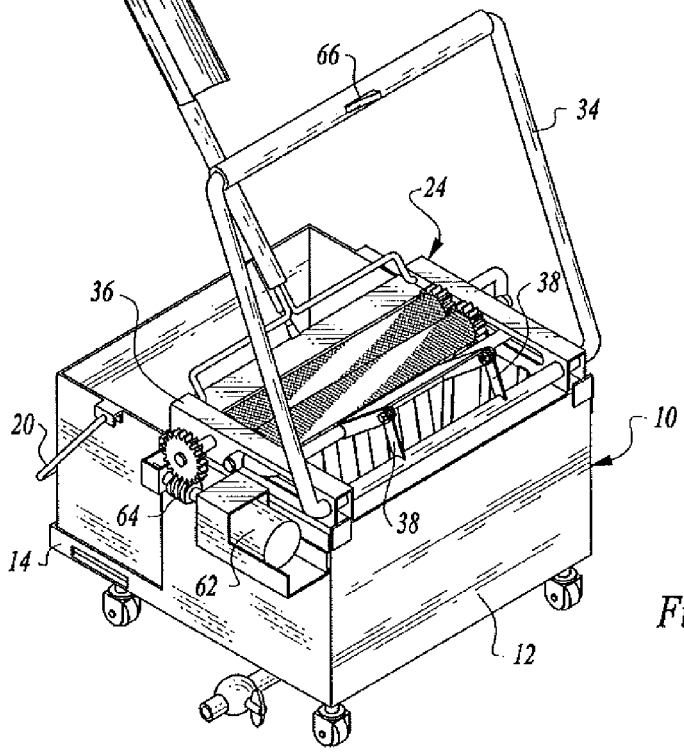
FIG. 2 is a rear, perspective view of the portable mop cleaning apparatus showing the handle in an alternative position and the rollers in nip forming relationship.

Referring to the drawings, portable mop cleaning apparatus constructed in accordance with the teachings of the present invention is illustrated. The apparatus includes a mobile cart 10 and a first tank 12 having a first tank interior. A receptacle 14 is positioned adjacent to the first tank. Wheels 16 in the form of caster wheels support the cart.

A second tank 18 is positioned on receptacle 14 and incorporates a handle 20 employed to facilitate installation or removal of the second tank 18. The second tank 20 is utilized to hold water or cleaning solution used when mopping a floor or other surface. In the drawings a conventional mop is illustrated and designated by reference number 22.

A mop cleaning assembly 24 is positioned on the first tank 12 and disposed over the first tank interior. The mop cleaning assembly includes a rotatable first roller 26 and a rotatable second roller 28.

The first and second rollers 26, 28 are relatively movable between a first condition (shown in FIGS. 1, 3, 8, 12) wherein the first and second rollers are disengaged sufficiently to allow a mop head of mop 22 to pass substantially freely between the first and second rollers when the mop head of the mop is manually inserted into the mop cleaning assembly and a second condition (shown in FIGS. 2, 4, 5, 6, 9, 10 and 11) wherein the first and second rollers form a nip with the mop head therebetween.

Handle 34 on the cart is operatively associated with the mop cleaning assembly 24 to cause relative movement of the first and second rollers between the first condition and the second condition. The handle 34 is pivotally mounted on a roller mounting framework 36 of the mop cleaning assembly, the handle passing through opposed openings located in spaced end portions of the roller mounting framework. Link arms 38 project upwardly from the bottom of the handle 34. The distal ends of the link arms 38 are pivotally connected to link members 40 which in turn are connected to an elongated member 42 which extends across the roller mounting framework and extends through opposed elongated slots 44 formed in the sides of the roller mounting framework.

The ends of the elongated member 42 are bent ninety degrees relative to the primary axis of the elongated member and have bearings 46 affixed thereto. The bearings 46 receive stub shaft ends 48 of second roller 28. Forward pivotal movement of the handle 34 relative to the cart will thus serve to move second roller 28 toward first roller 26 to form a nip therebetween.

A liquid deflecting shield 52 is supported by link members 40. The liquid deflecting shield has a proximal end 54 pivotally connected through link arms 38 to the handle and a distal end 56 slidably movable with the elongated member 42 relative to the mobile cart when the handle causes movement of the second roller relative to the first roller, the distal end being continuously maintained in close proximity to the second roller.

Located at an end of each of the first and second rollers is a gear 60 affixed thereto. When the rollers are brought together the gears 60 mesh with one another and a nip between the rollers is formed. See FIG. 11, for example.

The portable mop cleaning apparatus includes a roll rotation structure connected to the first roller for rotating the first roller. In the arrangement illustrated, the roll rotation structure comprises an electric motor 62 connected to the first roller. Interconnection between the first roller and the electric motor is by a gear drive comprising a worm gear 64. The electric motor is operated by an electric switch 66, suitably on handle 34, employed to energize or deenergize the motor which can be either battery operated or via a cord (not shown) connected to an electrical outlet.

Figures 3, 4, 5:
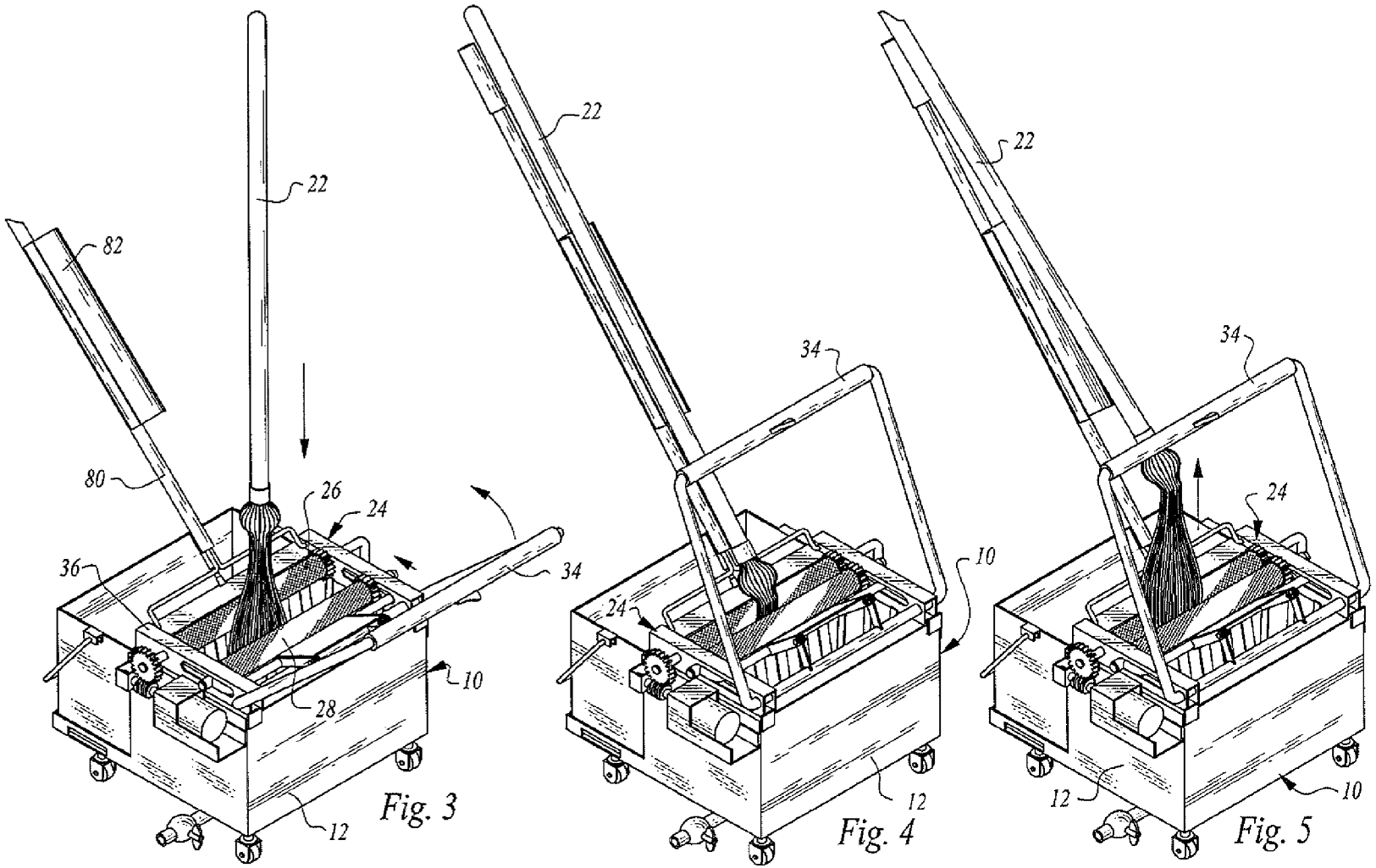
FIG. 3 is a rear, perspective view showing a mop head inserted into a space defined by the separated rollers and the handle in its initial position as shown in FIG. 1 preparatory to being moved in the direction of the arrow and preparatory to the rollers being brought into engagement.
FIG. 4 is a view similar to FIG. 3, but illustrating the mop head in a nip formed by the closed rollers, the mop handle resting on a mop support.
FIG. 5 is a view similar to FIG. 4, but showing upward movement of the mop caused by rotation of the rollers during the mop head wringing process.
Figure 6:
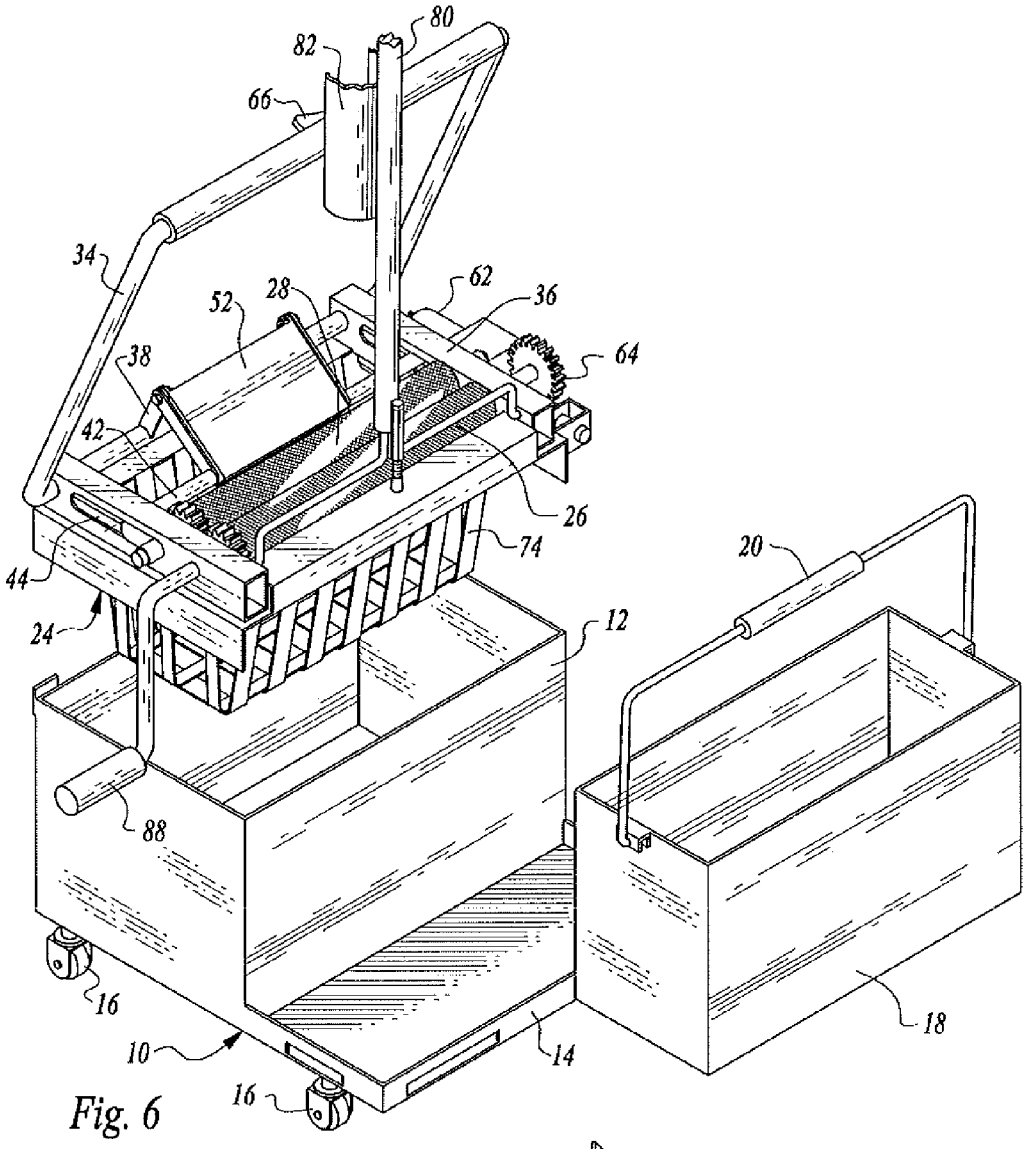
FIG. 6 is an exploded, perspective view showing selected structural components of the invention prior to assembly with the cart.
Figure 7:
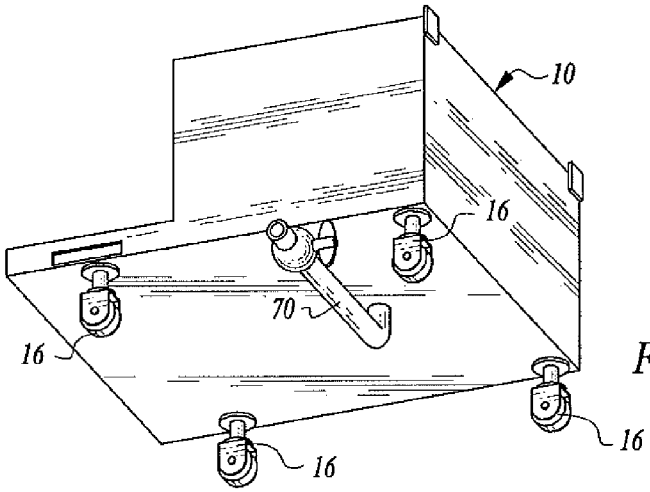
FIG. 7 is a bottom, perspective view of the cart.
Figure 8:
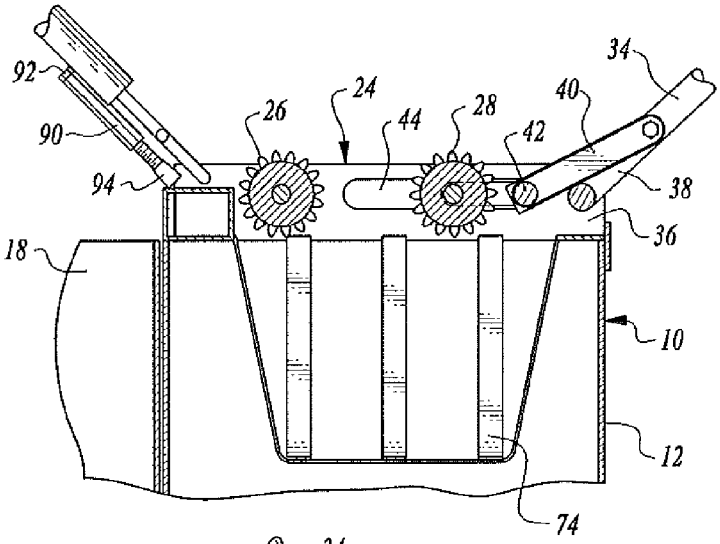
FIG. 8 is a sectional, side elevational view of selected components of the invention, the rollers being disengaged and spaced sufficiently apart to allow a mop head of a mop to pass substantially freely between the rollers.
Figure 9:
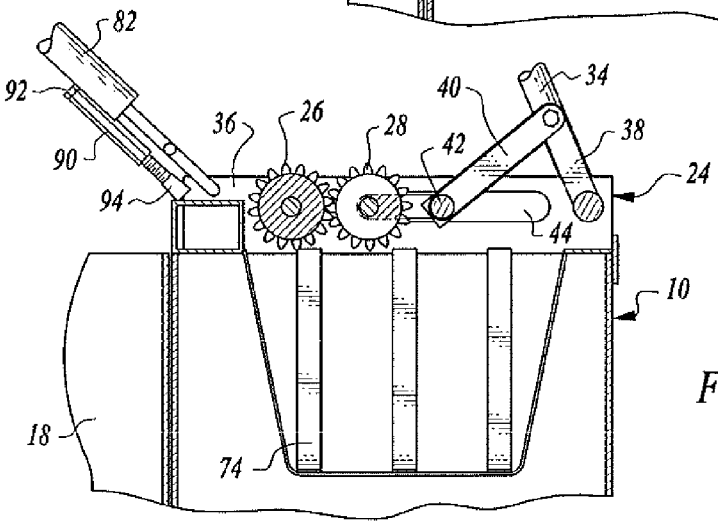
FIG. 9 is a view similar to FIG. 8, but showing the rollers forming a nip through which the mop head is to be raised.
Figure 10:
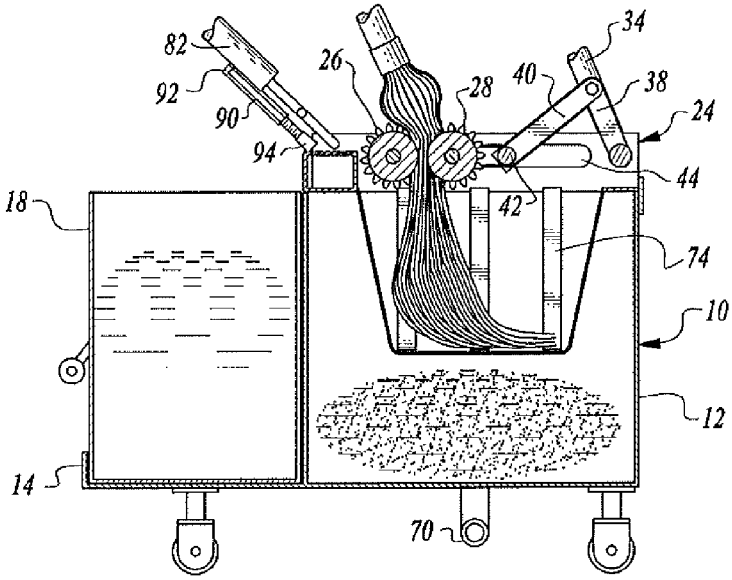
FIG. 10 is a side, elevational view in cross-section showing a mop head in the nip formed by the rollers when in closed position, the mop head located in a drain basket disposed under the rollers.
Figure 11:
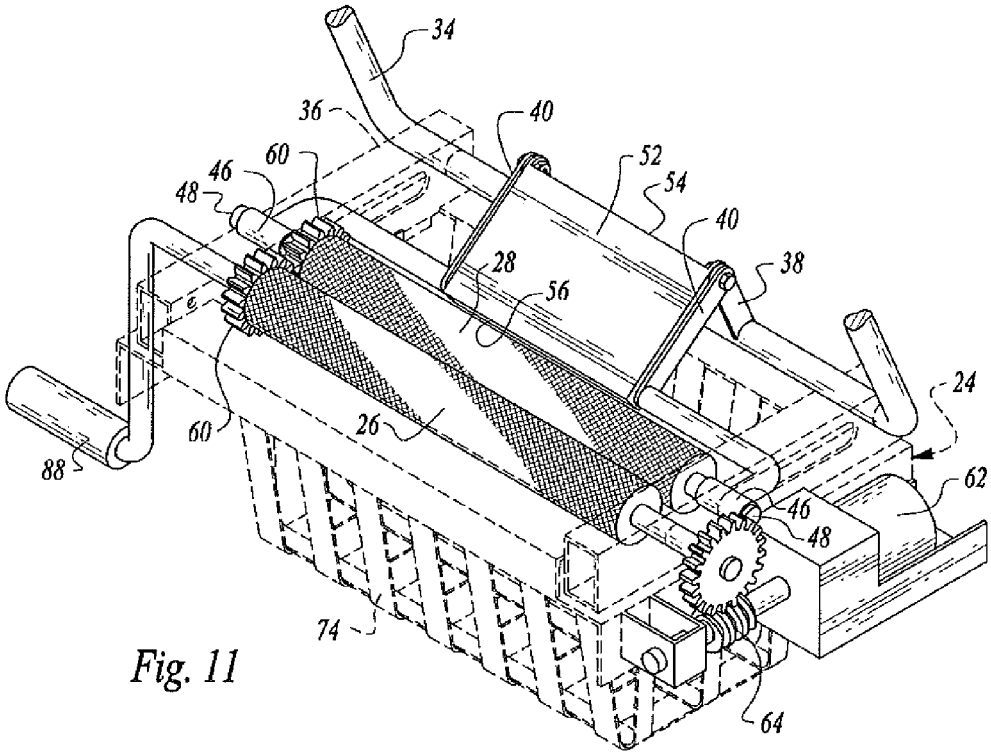
FIG. 11 is an enlarged, perspective view showing selected structural components of the invention including the rollers in closed position and a liquid deflecting shield connected to a portion of the handle when the handle is positioned to form a nip between the rollers.
Figure 12:
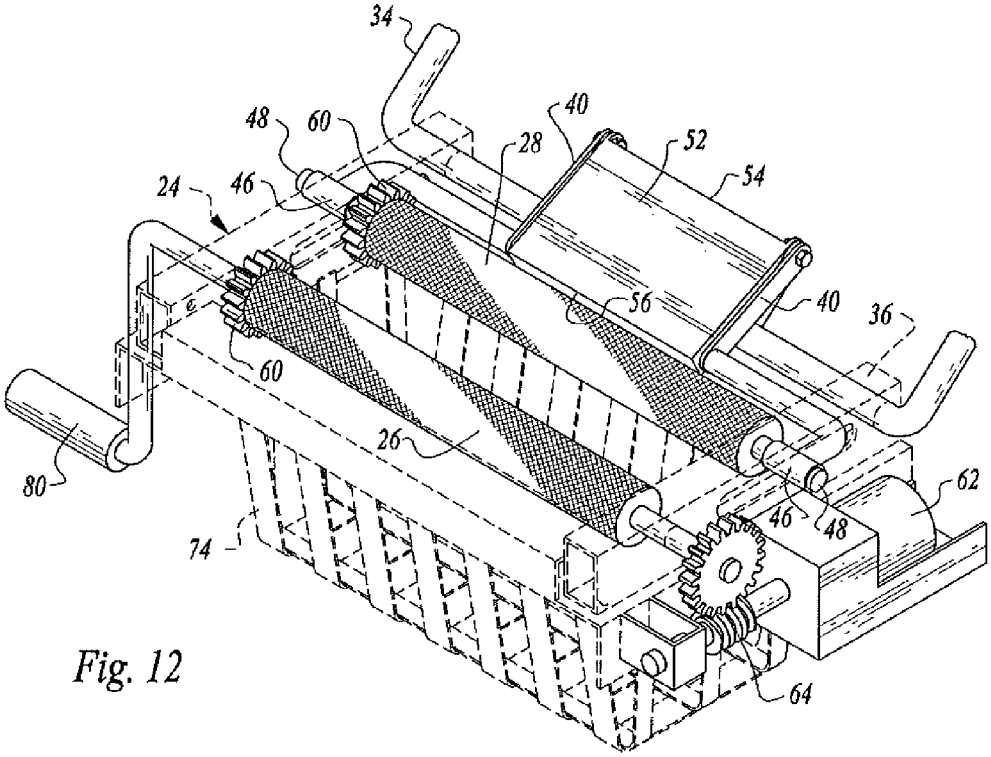
FIG. 12 is a view similar to FIG. 11, but showing the relative positions of the rollers, the liquid deflecting shield and a handle portion when the rollers have been separated and do not form a nip.

FIGS. 3-5 show the sequence of operations involved when cleaning a mop. The mop as shown in FIG. 3 is manually inserted so that the mop head enters the open space between the spaced first and second rollers. Next, as shown in FIG. 4, the handle 34 is pivoted forward to bring the rollers into nip forming position to exert a squeezing action on the mop head. After this has been accomplished, the operator operates the switch 66 to energize the motor to rotate the rollers and cause upward movement of the mop head. The dirty water or other cleaning liquid in the mop head is thus squeezed out and enters the interior of the first tank 12. A drain 70 is incorporated with the first tank so that the material therein can be drained out and discarded. The drain includes a drain pipe and on/off valve.

The mop cleaning assembly 24 additionally includes a drain basket 74 disposed under the first and second rollers, positioned within the first tank interior, and having liquid drain holes. This has the advantage of capturing any larger objects that may have attached themselves to the mop when in use and preventing them from collecting in the first tank interior. Also, the mop head remains elevated relative to the dirty liquid below the drain basket.

Another feature of the invention is a mop support 80 for supporting and guiding movement of the mop relative to the support rollers. The mop support 80 is pivotally connected to the cart at a location thereon spaced from the handle 34. The mop support 80 is elongated and includes a mop handle engagement portion in the form of a cradle 82 to maintain the mop positioned relative to the cart and the first and second rollers. See FIGS. 4 and 5, for example. It also stabilizes and supports the mop when the portable mop cleaning apparatus is being moved.

The arrangement illustrated also includes a hand cranked handle 88 which alternatively may be used instead of the motor to rotate the first roller 26. It should incorporate a one way clutch or other suitable mechanism so that it will not rotate with the first roller when the motor is employed as the drive means.

The invention claimed is:

1. Portable mop cleaning apparatus comprising, in combination:

a mobile cart including a first tank having a first tank interior;

a mop cleaning assembly positioned on said first tank and disposed over said first tank interior, said mop cleaning assembly including a rotatable first roller and a rotatable second roller, said first and second rollers relatively movable between a first condition wherein said first and second rollers are disengaged sufficiently to allow a mop head of a mop to pass substantially freely between the first and second rollers when the mop head is manually inserted into the mop cleaning assembly and a second condition wherein said first and second rollers form a nip with the mop head therebetween;

a handle pivotally mounted on said mobile cart operatively associated with said mop cleaning assembly for moving the mobile cart and for causing relative movement of said first and second rollers between said first condition and said second condition when said handle is pivoted relative to said cart;

a roll rotation structure connected to said first roller for rotating said first roller, said mop cleaning assembly additionally including a roller mounting framework defining opposed openings accommodating ends of said first roller allowing rotatable movement of said first roller but otherwise maintaining the first roller in a fixed position relative to said roller mounting framework, said roller mounting framework further defining opposed slots accommodating opposed ends of said second roller allowing both rotatable movement of said second roller and slidable movement of said second roller in said roller mounting framework responsive to pivotal movement of said handle alternatively toward or away from said first roller with said first roller and said second roller in parallel relationship, said handle pivotally connected to said second roller by interconnected link arms and link members; and a liquid impervious, non-flexible liquid deflecting shield supported by said link members having a proximal end pivotally connected to said handle and a distal end slidably movable relative to said mobile cart when pivotal movement of said handle and relative movement between said link arms and said link members causes movement of said second roller relative to said first roller, said distal end being continuously maintained in close proximity to said second roller and directed downwardly to direct liquid from a mop at the location of said first and second rollers into said first tank interior.

2. The portable mop cleaning apparatus according to claim 1 additionally comprising a mop support for supporting and guiding movement of the mop relative to the support rollers and said liquid impervious, non-flexible liquid deflecting shield, said mop support pivotally connected to said mobile cart at a location on said mobile cart spaced from said handle, said mop support being elongated and having a mop handle engagement portion to maintain the mop in position relative to said mobile cart, said liquid impervious, non-flexible liquid deflecting shield and said first and second rollers.

3. The portable mop cleaning apparatus according to claim 1 wherein said mop cleaning assembly additionally includes a drain basket disposed under said first and second rollers, positioned within the first tank interior, and having liquid drain holes, said liquid impervious, non-flexible liquid deflecting shield located over said drain basket.

* * * * *